US007841495B2

(12) United States Patent
Gouldson

(10) Patent No.: US 7,841,495 B2
(45) Date of Patent: Nov. 30, 2010

(54) INDICATORS FOR WIRE HOOK HANGERS

(75) Inventor: Stanley F. Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 311 days.

(21) Appl. No.: 11/170,412

(22) Filed: Jun. 29, 2005

(65) Prior Publication Data

US 2006/0011673 A1 Jan. 19, 2006

Related U.S. Application Data

(60) Provisional application No. 60/583,993, filed on Jun. 30, 2004, provisional application No. 60/669,610, filed on Apr. 8, 2005.

(51) Int. Cl.
*A41D 27/22* (2006.01)

(52) U.S. Cl. ..... 223/85; 40/322

(58) Field of Classification Search ..... 223/85, 223/88, 91, 98, DIG. 4; 40/322; D6/328
See application file for complete search history.

(56) References Cited

U.S. PATENT DOCUMENTS

| | | | | | |
|---|---|---|---|---|---|
| 1,389,266 | A | * | 8/1921 | Newton | 40/322 |
| 2,878,978 | A | | 3/1959 | Glowka | |
| 3,024,953 | A | | 3/1962 | O'Keefe | |
| 3,112,050 | A | * | 11/1963 | Eason | 223/98 |
| 4,040,545 | A | * | 8/1977 | Hill | 223/85 |
| 4,123,864 | A | * | 11/1978 | Batts et al. | 40/322 |
| 4,160,333 | A | * | 7/1979 | Indelicato | 40/322 |
| 4,198,773 | A | * | 4/1980 | Batts et al. | 40/322 |
| 4,333,590 | A | * | 6/1982 | Princiotta | 223/85 |
| 4,679,340 | A | * | 7/1987 | Johansson | 40/322 |
| 4,756,104 | A | * | 7/1988 | Bailey | 40/322 |
| 4,881,836 | A | * | 11/1989 | Blanchard | 40/322 |
| 5,096,101 | A | | 3/1992 | Norman et al. | |
| 5,377,884 | A | | 1/1995 | Zuckerman | |
| 5,503,310 | A | * | 4/1996 | Zuckerman et al. | 223/85 |
| 5,603,437 | A | * | 2/1997 | Zuckerman | 223/85 |
| 5,628,132 | A | * | 5/1997 | Marshall et al. | 40/322 |
| 5,687,887 | A | * | 11/1997 | Bond et al. | 223/85 |
| 5,778,575 | A | * | 7/1998 | Deupree et al. | 40/322 |
| 5,884,422 | A | * | 3/1999 | Marshall et al. | 40/322 |
| 5,950,883 | A | * | 9/1999 | Bond et al. | 223/85 |
| 6,019,260 | A | | 2/2000 | Gouldson | |

(Continued)

FOREIGN PATENT DOCUMENTS

DE 3306781 A1 * 8/1984

(Continued)

*Primary Examiner*—Gary L Welch
*Assistant Examiner*—Nathan E Durham
(74) *Attorney, Agent, or Firm*—Scully, Scott, Murphy & Presser, P.C.

(57) ABSTRACT

A metal wire hanger hook and indicator in combination, the metal wire hook having a curved top portion and a fixture secured to the metal wire hook, the fixture having a web for displaying indicia, the web including at least one abutment for engaging the indicator, and an indicator having an open cavity therein for receiving the web of the fixture, and means for engaging the abutment. More preferably the indicator is both removable and child-proof as defined by industry standards.

21 Claims, 7 Drawing Sheets

U.S. PATENT DOCUMENTS 6,041,983 A 3/2000 Sullivan et al.
6,209,241 B1 * 4/2001 Louw ..... 40/322
6,382,478 B2 5/2002 Gouldson et al.
6,409,057 B1 * 6/2002 Kim ..... 223/85
2002/0184799 A1 * 12/2002 Chou ..... 40/322

FOREIGN PATENT DOCUMENTS

GB 2010774 A * 7/1979

* cited by examiner

INDICATORS FOR WIRE HOOK HANGERS

CROSS-REFERENCE TO RELATED APPLICATIONS

This application claims priority under 35 U.S.C. §119(e) of U.S. Provisional Patent Application Ser. No. 60/583,993, filed 30 Jun. 2004, entitled "Topsizer for Wire Hangers", by Stanley Gouldson, and also of U.S. Provisional Patent Application Ser. No. 60/669,610, filed 8 Apr. 2005, entitled "Protective Fixture for Wire Hangers with Top-Sizers", also by Stanley Gouldson, the entire disclosures of which are hereby incorporated by reference for all purposes.

BACKGROUND OF THE INVENTION

1. Field of Invention

The invention relates to the fields of retail sales and of hangers for suspending articles from a support structure. More particularly, the invention relates to indicators for use with a wire hook hangers.

2. Description of Related Art

In the area of retail garment sales, so-called Garment-On-Hanger (GOH) programs have become preferred by retailers. In a GOH program, garments are delivered to retail merchants already suspended from hangers, whereupon arrival at the retail location they may immediately be placed on display for sale. Formerly, retailers accomplished the task of placing garments on hangers with labor provided at their own expense.

In particular, retailers have specified particular hangers or hanger characteristics among their several merchandise suppliers in order to achieve a visually pleasing uniformity on their sales floors. To this end, standards as to hanger size, shape, performance characteristics, etc., are maintained, for example, by organizations such as the Voluntary Inter-industry Commerce Standards Association (VICS). One particular standardized hanger feature is extremely popular across several hanger models, namely a turnable wire hook mated to a plastic hanger.

Additionally, and interrelated to the promulgation of GOH programs, retailers and their customers desire to have the hanger itself display some indicia regarding the item carried upon it. Categories of indicia could include manufacturer, material and price, but most notably for garments, their size. Various means for accomplishing this have been developed, including those disclosed in U.S. Pat. No. 5,884,422, issued 23 Mar. 1999 to Marshall, et al., and U.S. Pat. No. 6,019,260 to Gouldson, the disclosures of both of which are hereby incorporated by reference in their entirety for all purposes, and both of which are commonly assigned with the instant application, among others.

Popular among these are the type disclosed in the former patent mentioned to Marshall, i.e., a top-sizer indicator fitted atop the hook of a hanger. Its prominence in the retail clothing sales industry is attributable to its quick, easy and ready identification of some characteristic of the article hung from the hanger, generally its size. Others secure to the hanger adjacent the intersection of the hook and the hanger body to one side of the hook, appropriately called side-sizer tabs, or simply side-sizers; lower neck sizers or indications.

These heretofore known indicators, top or side, have had limitations. Generally, the hangers which were designed to support and hold top or side sizers were unitarily formed of an injection molded plastic. Despite the advantages of a plastic hanger, certain applications, and/or certain segments of the marketplace demand a metal hanger, or at least hanger having a metallic wire hanger hook. However, wire hanger hooks, as known in the art, have no provision to support a sizer, particularly a removable top sizer or side sizer.

Additionally, such metallic wire-hanger hooks may be prone to corrosion when exposed to humidity in the air, as occurs for example during shipment via ocean-going vessel, and/or when displayed for sale in humid climates. The wire-hanger hooks may be made of a corrosion-resistant metal, but this is costly. Alternately, a plating of corrosion-resistant metal may be applied to a less costly, corrosion-prone base metal, in order to protect the base metal from exposure. This solution has the drawback that when hung from a hard (e.g., metal) support, as in transit or on display, the corrosion-resistant plating may be scraped off, exposing the base metal and making corrosion more likely. Therefore, an improved solution is wanting.

Moreover, these indicators, both top sizers and side sizers, are typically of a size that can present a choking hazard to small children. Therefore, it is desirable for these indicators to be child-resistant, or resistant to removal by a small child.

BRIEF SUMMARY OF THE INVENTION

Accordingly, it is an object of the present invention to provide an indicator or sizer for attachment to a wire hanger hook which can be removable or non-removable, but in any case is child resistant, or resistant to removel by a small child. It is a further object of the present invention to provide a means for adapting a wire hanger hook to receive a sizer. It is a further object of the present invention to provide a sizer for a wire hanger that is interchangeable with those used on molded plastic hangers.

In order to meet these and other objectives, provided according to the present invention is a metal wire hanger hook and indicator in combination, the metal wire hook having a curved top portion, a fixture secured to the metal wire hook, the fixture having a web for receiving an indicator thereon, the web including at least one abutment for engaging the indicator, and an indicator having an open cavity therein for receiving the web of the fixture, and means for engaging the abutment.

Alternately or additionally, the fixture may include a barrier along an inner curvature of the metal wire hook, the barrier providing a standoff between the metal wire hook and a support from which the hanger can be hung. The barrier may also be in the form of a coating or sheath applied to an exterior of the wire hook or some part thereof. The sheath can be provided to the wire hook in the absence of any fixture. The sheath may also be associated with the fixture as aforesaid.

BRIEF DESCRIPTION OF THE DRAWINGS

These and other features, advantages and benefits of the present invention will be made apparent with reference to the following specification and accompanying drawings, wherein like reference numerals refer to like structures across the several views, and wherein:

FIG. 1(*a*) illustrates in lateral side view, an uppermost portion of the embodiment of FIG. 1;

FIG. 2(*a*) illustrates in lateral side view, an uppermost portion of the embodiment of FIG. 2;

FIG. 3(*a*) illustrates in lateral side view, an uppermost portion of the embodiment of FIG. 3;

FIG. 8(*a*) illustrates in lateral side view, an uppermost portion of the embodiment of FIG. 8;

FIG. 9(*a*) illustrates an end view of a typical side sizer; and

FIG. 9(*b*) illustrates the fixture of FIG. 9(*a*) including the size sizer of FIG. 9(*b*) mounted thereon.

DETAILED DESCRIPTION OF THE INVENTION

Figure 1:
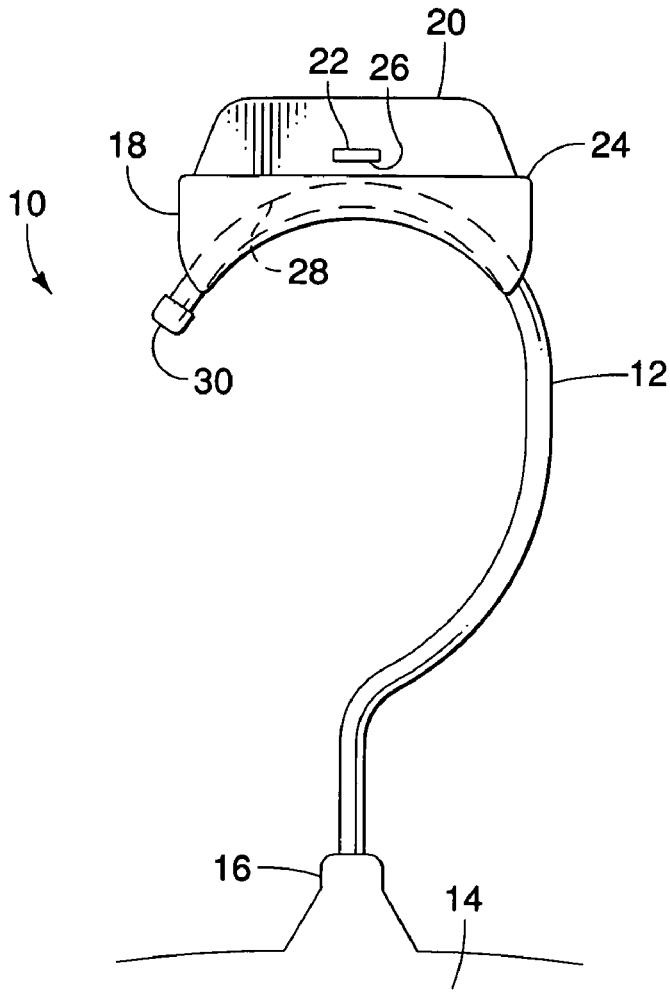
FIG. 1 illustrates a front view of a fixture for adapting a wire hanger hook to receive a top sizer according to a first embodiment of the present invention.
Figure 1A:
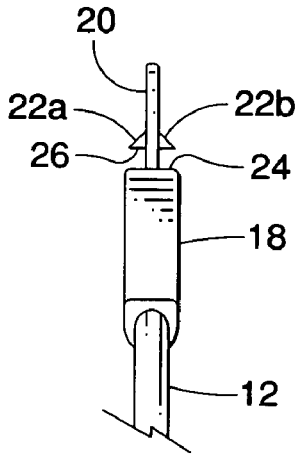

Referring now to FIG. 1, shown in cutaway view is a central top portion of a hanger, generally 10, having a metal wire hook 12 joined to the body of the hanger 14 at a neck 16. A mounting fixture 18 is secured to the hook 12 generally, though not exclusively, at a top thereof. Mounting fixture 18 is typically formed of a molded plastic material, which in one embodiment is molded in situ on the hook 12. Extending outward from the fixture 18 is a web 20, intended to be received within a cavity of an indicator placed thereon. An abutment 22 extends laterally from the web 20 for interlock with certain indicators configured to receive the abutment 22, and may include a horizontal surface 26 along an underside thereof for that purpose.

Figure 8:
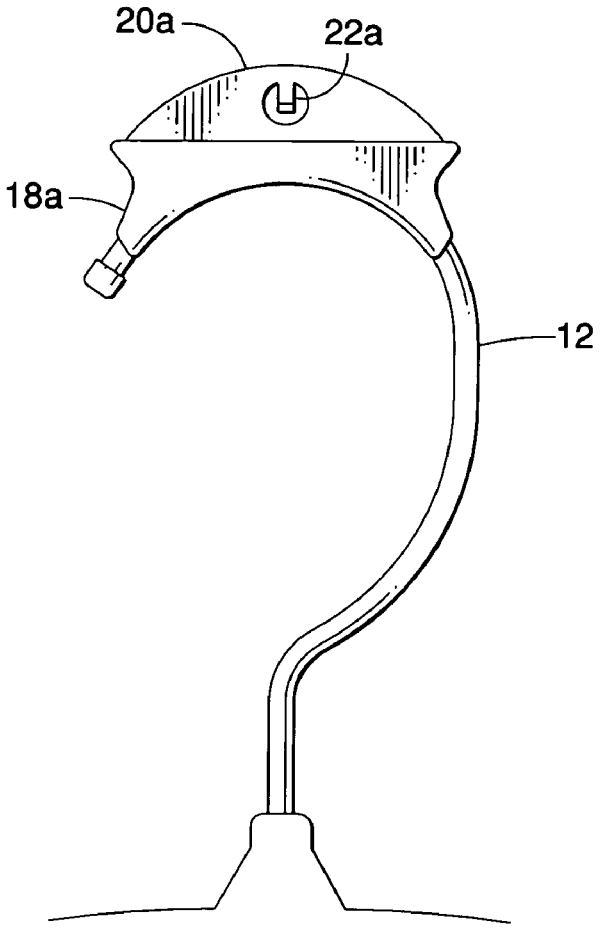
FIG. 8 illustrates a front view of an alternate embodiment of a fixture for adapting a wire hanger hook to receive a top sizer.
Figure 8A:
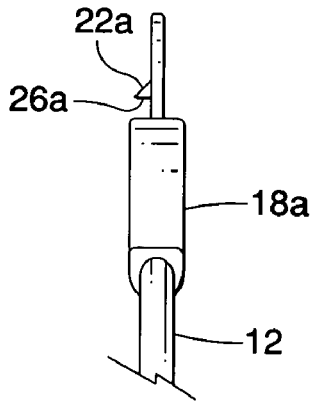

In an alternate embodiment, illustrated generally in FIGS. 8 and 8(*a*), a fixture 18*a* includes an abutment 22*a* fixed in a cantilever manner to web 20*a*, and extending laterally from the fixture 18*a* to engage the indicator via a horizontal surface 26*a*, and secure the indicator to the fixture 18*a*. Where an indictor is provided with a through hole at the point of engagement with abutment 22*a*, insertion of a pin or similar tool into this through hole facilitates the release and removal of the indicator. However, under all other circumstances the indicator is held securely to the fixture 18*a*. This embodiment, and all the embodiments are thus childproof as defined by industry standards, e.g., those promulgated by Bureau Veritas Consumer Product Services, Inc. The embodiment of FIGS. 8 and 8(*a*) has the added benefit of being readily removable while also being childproof.

Also provided is a ledge 24 (FIG. 1) intended to be approximately the same dimension as a lower extremity of an indicator mounted thereon and positioned adjacent to such ledge 24. Ledge 24 inhibits the ability to remove the indicator by flexing a sidewall thereof away from abutment 22, in part by obstructing access to the lower extremity of the indicator.

Fixture 18 includes a channel 28 therethrough for receiving the hook 12, for example in embodiments that are not molded in situ. In such an embodiment, the hook 12 is inserted through the channel 28. The free end of the hook 12 may be deformed to prevent the fixture from subsequently sliding off the hook 12, for example by stamping a deformation into the free end 30, or by bending the free end 30 tightly back upon itself, typically but not exclusively in an upward direction, in a manner known in the art. The terminus of the free end 30 subsequent to such bending may prevent any movement of the fixture 18 in the direction of the free end 30.

FIG. 1(*a*) shows an uppermost portion of the embodiment of FIG. 1 in lateral side view. In this particular embodiment, two abutments 22*a*, 22*b* are provided, one on each side of web 20. However, one may be provided, on either of one side, or more than one on either side, as necessary or desirable to interface with a predetermined indicator.

Figure 2:
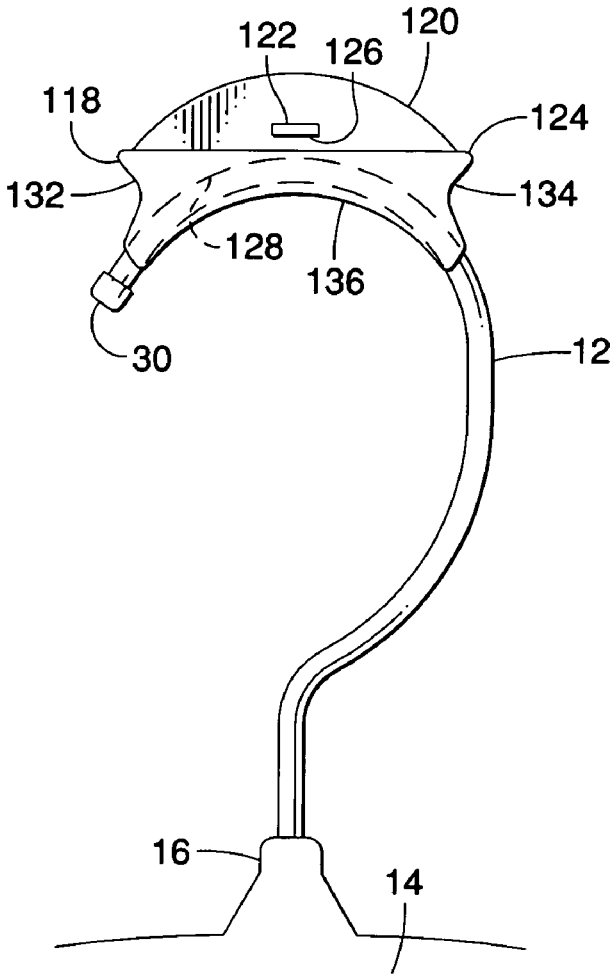
FIG. 2 illustrates a front view of an alternate fixture for adapting a wire hanger hook to receive a top sizer according to a second embodiment of the present invention.
Figure 2A:
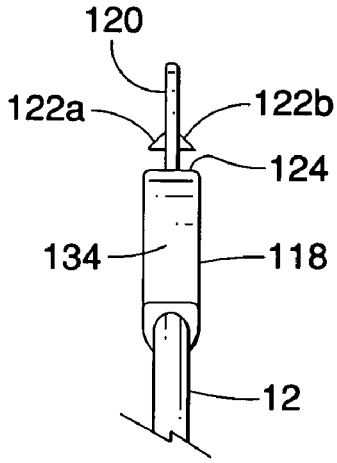

Referring to FIGS. 2 and 2(*a*), shown is a second embodiment of the present invention. A detailed description of features that will be seen as generally similar to corresponding features of the embodiment of FIG. 1 will be omitted. Among the distinctions with the embodiment of FIG. 1 is the sweeping curvature of the web 120. The profile shape of web 120 is matched to a predetermined indicator that is to be placed on the fixture 118. It also provides a different profile if the hanger is to be used without an indicator. FIG. 2(*a*) shows an uppermost portion of the embodiment of FIG. 2 in lateral side view.

On either side of the fixture 118, grips 132, 134 may be provided. These provide a place where the fixture 118 may be grasped by hand or by machine, for the mounting or removal of an indicator therefrom. However, this form is not dictated by the function of providing a griping place. Suitable grips can be provided with straight rather than curved indentations, or a convex shape, straight or curved, extending outward from the fixture 118.

Moreover, in certain embodiments, the fixture 118 may be provided with an open bottom 136. Accordingly, the hook 12 may be placed in the channel 128 through the open bottom 136, and the fixture 118 may be held in place by a snap fit to the hook 12, an adhesive, or other appropriate means as will be apparent to those skilled in the art in light of the present disclosure. Alternately, the fixture 118 may be unitarily molded in situ, at least partially surrounding the hook to secure it thereto. In such an embodiment, the bottom need not be open.

Figure 3:
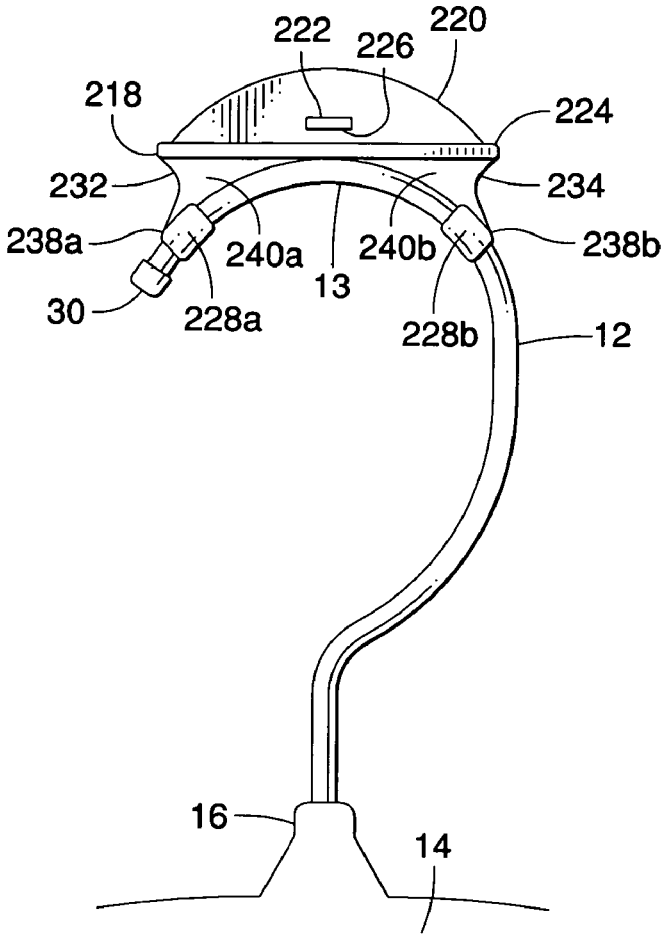
FIG. 3 illustrates a front view of a fixture for adapting a wire hanger hook to receive a top sizer according to a third embodiment of the present invention.
Figure 3A:
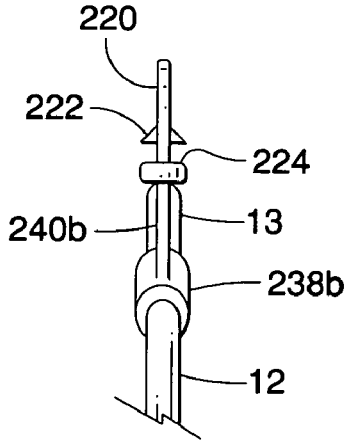

Referring now to FIGS. 3 and 3(*a*), shown is a third embodiment of the present invention. A detailed description of features that will be seen as generally similar to corresponding features of the embodiment of FIGS. 1 and 2 will be omitted. Among the distinctions with other embodiments are points of engagement 238*a*, 238*b*, with the hook 12. Rather than engaging a contiguous top potion 13 of the hook 12, fixture 218 has separated points of engagement 238*a*, 238*b*. Two are shown, though more or fewer can be provided. The fixture can be unitarily molded on the hook 12, or the hook 12 passed through channels 228*a*, 228*b*, as described with reference to the foregoing embodiments.

Alternately, the points of engagement 238*a*, 238*b* may have respective openings to receive the hook 12 from below or from a side, and snap fit or adhere in place. In one particular embodiment an opening is provided on opposite sides of the points of engagement 238*a*, 238*b*. Accordingly, the fixture may be placed atop the hook 12 at least partially rotated around a vertical axis thereof, and the fixture 218 rotated into engagement with the hook 13.

This embodiment has several advantages. Among them, the bulk of material compared to a first or second embodiment is reduced. In addition to cost savings, this may be more visually pleasing. Further, the top portion 13 of the metal hook 12 is free to ride on a support from which the hanger is hung, typically a cylindrical bar (not shown), with minimal if any contact with between the cylindrical bar and the fixture 218. Note also that the lower flange 240*a*, 240*b* is reduced in width relative to the previously described embodiments. Each lower flange 240*a*, 240*b* may also be offset to one side or the other, independently of one another, and may extend at least to a side of the top section 13 of the hook 12.

In contrast to the third embodiment of FIGS. 3 and 3(*a*), the fixture may specifically provide a barrier between a support (not shown) from which the hanger is hung, and the wire hook 12, specifically along its inner curvature, particularly at a top portion 13. This barrier may be provided (or omitted) whether the fixture 18 is molded in situ, the wire hook 12 is inserted through the channel 28 post-molding, or the fixture 118 is placed on the hanger via open bottom 136. Moreover, the barrier may, but need not, be continuous over the length of the wire hook 12 to provide protection between the wire hook 12 and a support from which the hanger is hung, i.e., an effective barrier may be formed by a sufficient number and/or inner thickness of engagement points 228(*a*) and (*b*).

Figure 6:
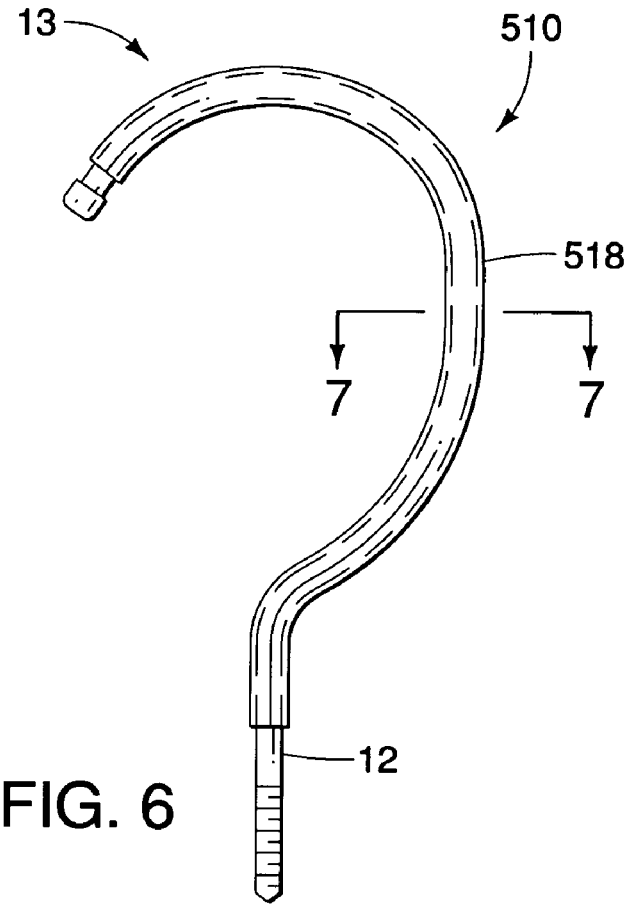
FIG. 6 illustrates a front view of a wire hanger hook according to a fifth embodiment of the present invention.

Referring now to FIG. 6, illustrated is a front view of a wire hanger hook according to a fourth embodiment of the present invention. In this embodiment, the fixture comprises a protective sheath 518 that extends farther down the wire hook 12 than previous embodiments. In so doing, the protective sheath 518 prevents any contact between wire hook 12 and a support from which the hanger is hung (not shown). Protective sheath 518 need not extend the full or nearly the full length of the top portion 13 of wire hook 12, but can extend a lesser amount yet still provide adequate protection between the support and portions of the wire hook 12 like to contact the support.

Figure 7:
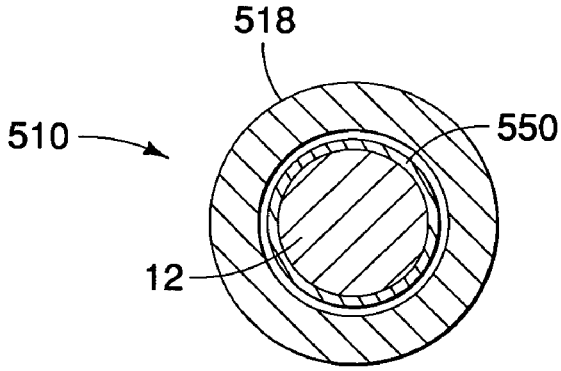
FIG. 7 illustrates a cross-sectional view taken along line 7-7 of FIG. 6.

Turning now to FIG. 7, illustrated is a cross-sectional view taken along line 7-7 of FIG. 6. As shown in cross section, the wire hook 12 has a plating layer 550 of a corrosion-resistant metal, for example nickel, though other corrosion-resistant metals are known in the art and may be substituted. Preferably, plating layer 550 is provided with a high luster for an attractive visual appearance. Surrounding the plating layer 550 is protective sheath 518. Protective sheath 518 is preferably transparent, particularly when the plating layer or the base metal of wire hook 12 includes a high luster, but may be other colors.

Moreover, the protective sheath 518, when formed of a plastic material of the class described for the fixture 18 in general, can prove to be more cost effective than the plating layer 550 itself. Therefore, protective sheath 518 may provide corrosion resistance in place of the plating layer 550, and thereby obviate the need for a plating layer 550 itself. In addition, there are environmental benefits that flow from reducing the amount of nickel or other plating materials in the environment, as well as the chemical by-products of their application to the hook 12.

Figure 4:
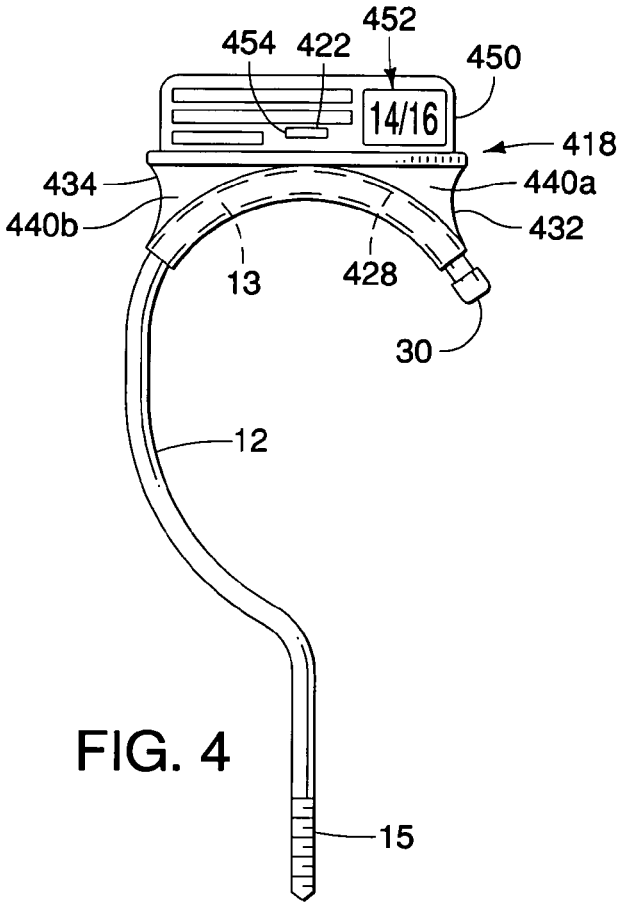
FIG. 4 illustrates a rear view of a fixture for adapting a wire hanger hook to receive a top sizer according to a fourth embodiment, and a top sizer indicator mounted thereon.
Figure 5:
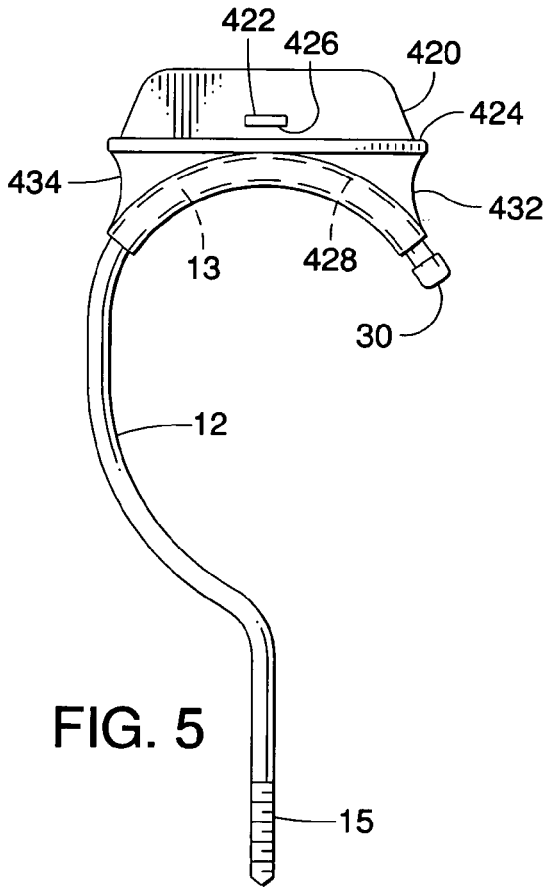
FIG. 5 illustrates a reverse view of a fixture for adapting a wire hanger hook to receive a top sizer according to the fourth embodiment of FIG. 4.

Turning now to FIGS. 4 and 5, shown are a reverse view (relative to FIGS. 1-3) of a hook 12 and a fixture 418 according to a fifth embodiment of the present invention, with and without a top sizer indicator 450 mounted thereon, respectively. A detailed description of features that will be seen as generally similar to corresponding features of the embodiments of the foregoing figures will be omitted.

Indicator 450 has an internal cavity (not shown) for receiving web 420 therein. Preferably, indicator 450 also has an opening 454 in a sidewall thereof for engaging abutment 422, and interlocking therewith. The opening 454 may be a through opening, as shown. Alternately, the opening may be a relief in an inner side wall of the indicator for receiving abutment 22. In either a through opening or a relief embodiments, a horizontal shelf may be provided for mating with a horizontal shelf 426 provided on the abutment 422.

Indicator 450 may also have sizing indicia 452 printed thereon. However, the indicia may be molded into the indicator 450, as alphanumeric or other symbols, or alternately, the color of the indicator itself may be indicative. Moreover, the indicia may refer to another characteristic of an article to be hung from the hanger, for example manufacturer or color, among others. Such indicia may be combined to refer to multiple and/or independent characteristics.

As seen with respect to FIG. 5, the fixture 418 has a web 420 having a profile similar to that of FIG. 1. It also includes grips 432, 434, similar to FIG. 2, and reduced width lower flange 440*a*, 440*b*, similar to FIG. 3, notwithstanding that the channel 428 surrounds a contiguous top portion 13 of the hook 12. Therefore, one skilled in the art would appreciate that the features of the various embodiments are not necessarily present to the exclusion of any features from other embodiments, but may be combined and/or interchanged according to the requirements of a particular application. Also shown in FIGS. 4 and 5 are threads 15 provided to enhance the interface with the hanger body 14 and neck 16. Circular threads 15 are shown, but helical threads may also be used in certain applications, in a manner generally known in the art.

Various other styles and types of indicators may be used, with the fixture having appropriate features for receiving the indicators. For example, releasable indicators are disclosed in U.S. Pat. No. 6,499,634, issued 31 Dec. 2002 to Olk, et al., which is commonly assigned with the instant application, and is hereby incorporated by reference in its entirety for all purposes. Such releasable indicators may be those disclosed for use at a top of the hanger hook, or those disclosed for use at the base or neck of the hanger hook. In fact, either style may be used at any place along the hook according to the present invention.

Figure 9:
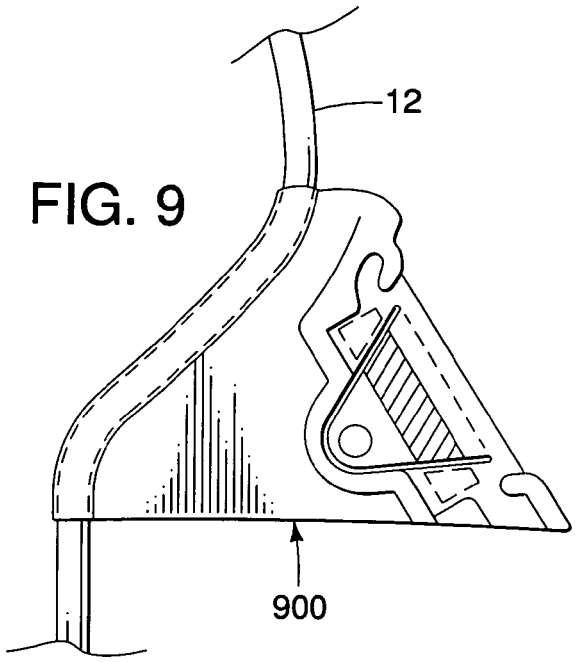
FIG. 9 illustrates a partial front view of a fixture for adapting a wire hook hanger to receive a side sizer.
Figure 9A:
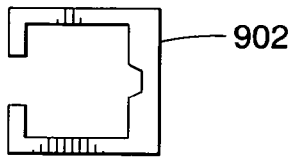
Figure 9B:
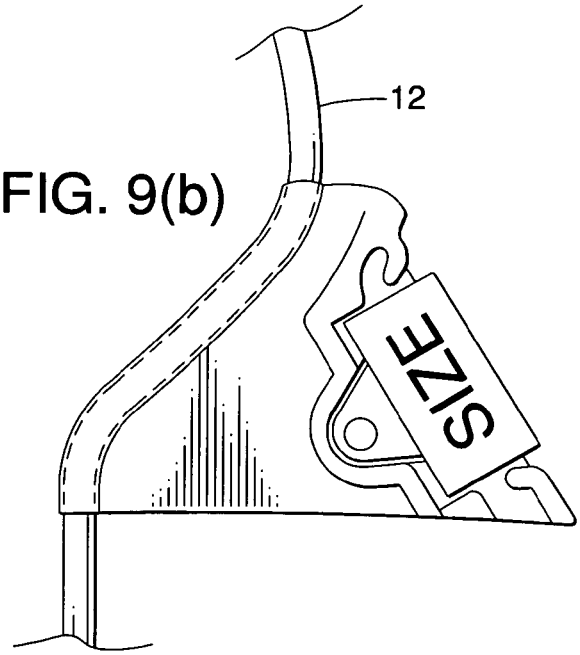

An example of the foregoing embodiment is illustrated in FIGS. 9, 9(*a*), and 9(*b*), the features of which are described more fully in U.S. Pat. No. 6,499,634, incorporated above. For the purposes of the present invention, it is sufficient to state that hook 12 has a web, generally 900, affixed thereto. Web 900 is configured to secure a sizer tab 902 (FIG. 9(*a*)) in a childproof manner thereto. The web 900 and side sizer 902 are shown together in FIG. 9(*b*).

The process of unitarily molding the fixture or sheath in situ will be further described. In any of the foregoing embodiments, taking merely as an example the first (FIG. 1) and fourth (FIG. 6) embodiments, the fixture 18 or sheath 518 may be unitarily molded onto the hook 12. Accordingly, the hook 12 is received within the cavity of a mold. The mold cavity defines the fixture 18 or sheath 518 and its various features. The hook 12 is held within the mold cavity in a desired orientation relative to the fixture or sheath defined by the mold cavity, preferably in such a manner as to avoid contact between the hook 12 and the inner surface of the mold cavity. Thereafter, a molten material, for example a plastic, is introduced into the mold cavity. After a suitable cooling period, the fixture 18 or sheath 518 is then formed unitarily with the hook 12, and both are removed from the mold cavity. Plastics considered suitable for such fixtures include polystyrene, polypropylene, PET, K-resin, or variants of any of these, among others. The molten material may also be a metal or alloy.

The present invention has been described herein with reference to certain exemplary embodiments. Various alterations and/or modifications will be apparent to those skilled in the art in light of the present disclosure. Therefore, these embodiments are meant to be illustrative, and not limiting on the scope of the present invention, which is defined solely with reference to the appended claims.

The invention claimed is:

1. A hanger hook and indicator comprising, in combination:

a metal wire hook having a curved top portion, a free end and a fixed end, the fixed end coupled to a body of a hanger;

a fixture secured to the metal wire hook, the fixture comprising a tubular enclosed channel extending continuously within the fixture for accommodating the curved top portion of the hook, the tubular enclosed channel comprising opposite openings to allow both the free end and the fixed end of the metal wire hook to be exposed beyond the fixture, the fixture having a web including at least one abutment for engaging an indicator; and an indicator having an open cavity therein for receiving the web of the fixture, and means for engaging the abutment.

2. The hanger hook and indicator according to claim 1, wherein the means for engaging the abutment comprises an opening in the sidewall of the indicator.

3. The hanger hook and indicator according to claim 1, wherein the means for engaging the abutment comprises a finger extending inward from the sidewall of the indicator.

4. The hanger hook and indicator according to claim 1, wherein the abutment comprises one or more of a fixed latch and a pivoting latch provided on the fixture.

5. The hanger hook and indicator according to claim 1, wherein the abutment comprises horizontal surface positioned to engage an opening in the sidewall of the indicator.

6. The hanger hook and indicator according to claim 1, wherein the fixture further comprises means to inhibit the removal of the indicator.

7. The hanger hook and indicator according to claim 6, wherein the means to inhibit the removal of the indicator further comprises a ledge adjacent a lower extremity of the indicator when it is carried on the fixture.

8. The hanger hook and indicator according to claim 1, wherein the fixture further comprises an indentation for providing a gripping surface.

9. The hanger hook and indicator of claim 1, wherein the fixture is unitarily molded to the metal wire hook.

10. A hanger having a metal wire hook and a fixture unitarily molded on the hook, wherein said metal wire hanger hook comprises a curved top portion, a free end and a fixed end, the fixed end coupled to a body of a hanger, the wire hanger hook being received in the cavity of a mold, the mold cavity defining a fixture having at least one point of engagement at least partially surrounding the wire hanger hook, the fixture further having a web including at least one abutment for engaging an indicator, wherein the fixture is secured to the metal wire hook by introducing a molten material into the mold cavity, the fixture comprising a tubular enclosed channel extending continuously within the fixture for accommodating the curved top portion of the hook, the tubular enclosed channel comprising opposite openings to allow both the free end and the fixed end of the metal wire hook to be exposed beyond the fixture.

11. The hanger according to claim 10, wherein the abutment comprises one or more of a fixed latch and a pivoting latch provided on the fixture.

12. The hanger according to claim 10, wherein the abutment comprises horizontal surface positioned to engage an opening in the sidewall of the indicator.

13. The hanger according to claim 10, wherein the fixture further comprises means to inhibit the removal of the indicator.

14. The hanger according to claim 13, wherein the means to inhibit the removal of the indicator further comprises a ledge adjacent a lower extremity of the indicator when it is carried on the fixture.

15. The hanger according to claim 10, wherein the fixture further comprises an indentation for providing a gripping surface.

16. The hanger according to claim 10, wherein the fixture is secured to the metal wire hook along a continuous length of the hook.

17. The hanger of claim 10, wherein the fixture is unitarily molded to the metal wire hook.

18. A hanger hook and indicator comprising, in combination:

a metal wire hook having a curved top portion, a free end and a fixed end, the fixed end coupled to a body of a hanger;

a fixture secured to the metal wire hook, the fixture comprising a tubular enclosed channel extending continuously within the fixture for accommodating the curved top portion of the hook, the tubular enclosed channel comprising opposite openings to allow both the free end and the fixed end to be exposed beyond the fixture, the fixture having a web including means for engaging an indicator; and an indicator having an open cavity therein for receiving the web of the fixture and means for engaging the web.

19. The hanger hook and indicator of claim 18, wherein the fixture is unitarily molded to the metal wire hook.

20. A hanger hook and indicator comprising, in combination:

a metal wire hook having a curved top portion, a free end and a fixed end, the fixed end coupled to a body of a hanger;

a fixture secured to the metal wire hook, the fixture comprising a tubular enclosed channel extending continuously within the fixture for accommodating the curved top portion of the hook, the tubular enclosed channel comprising opposite openings to allow both the free end and the fixed end to be exposed beyond the fixture, the fixture having means for operatively attaching an indicator; and an indicator having means for operatively engaging the fixture.

21. The hanger hook and indicator of claim 20, wherein the fixture is unitarily molded to the metal wire hook.

* * * * *